US008499846B2

(12) United States Patent
Whitney, Sr.

(10) Patent No.: US 8,499,846 B2
(45) **Date of Patent: *Aug. 6, 2013**

(54) FIRE EXTINGUISHING DEVICE

(76) Inventor: Sterling Whitney, Sr., Philadelphia, PA (US)

( * ) Notice: Subject to any disclaimer, the term of this patent is extended or adjusted under 35 U.S.C. 154(b) by 341 days.

This patent is subject to a terminal disclaimer.

(21) Appl. No.: 12/699,059

(22) Filed: Feb. 3, 2010

(65) Prior Publication Data

US 2010/0132964 A1 Jun. 3, 2010

Related U.S. Application Data

(63) Continuation-in-part of application No. 11/832,664, filed on Aug. 2, 2007, now Pat. No. 7,661,482.

(51) Int. Cl.

| | |
|---|---|
| ***A62C 3/00*** | (2006.01) |
| ***A62C 13/00*** | (2006.01) |
| ***A62C 13/78*** | (2006.01) |
| ***A62C 37/08*** | (2006.01) |
| ***B05B 9/04*** | (2006.01) |

(52) U.S. Cl.
USPC ..... 169/56; 169/9; 169/26; 169/30; 169/85; 169/89; 239/373

(58) Field of Classification Search
USPC ..... 169/9, 16, 17, 26, 30, 42, 54, 56–58, 169/60, 72, 74, 76, 85, 89; 239/74, 373
See application file for complete search history.

(56) References Cited

U.S. PATENT DOCUMENTS

| | | | | |
|---|---|---|---|---|
| 1,831,193 | A * | 11/1931 | Quitschalle | 169/51 |
| 5,458,201 | A * | 10/1995 | Brim | 169/26 |
| 6,009,954 | A * | 1/2000 | Phillips | 169/16 |
| 6,276,460 | B1 * | 8/2001 | Pahila | 169/37 |
| 2003/0080445 | A1 * | 5/2003 | Howe | 261/72.1 |

* cited by examiner

*Primary Examiner* — Darren W Gorman
(74) *Attorney, Agent, or Firm* — Dovas Law, P.C.

(57) ABSTRACT

The present invention provides a fire extinguishing device including an upright standing hollow body. An air compressor pump is connected to the hollow body for providing pressurized air to the hollow body. At least one heat activated fluid release valve is connected to the hollow body. The present invention further provides a method of configuring a tree display.

16 Claims, 7 Drawing Sheets

FIRE EXTINGUISHING DEVICE

CROSS REFERENCE TO RELATED APPLICATION(S)

This application is a continuation-in-part of U.S. patent application Ser. No. 11/832,664, filed Aug. 2, 2007, which is incorporated by reference as if fully set forth.

BACKGROUND

Each year, hundreds of trees used in the celebration of holidays catch fire causing property damage and in some cases injury and loss of life. The ubiquitous "Christmas" tree, typically an evergreen such as a Douglas Fir, Blue Spruce, and Norway spruce, is often laden with decorations including electric lights as part of yearly Christmas festivities in the United States and other countries. Such lights often generate significant amounts of heat resulting in fire risk. A fire started on a portion of the tree may quickly consume the entire tree and spread to surrounding furnishings or building structure. Even in the case where a fire in a tree is quickly extinguished, significant damage to surrounding building structure and furnishings may occur.

It would be desirable to provide a device which would be effective in preventing the spread of a fire started in a tree within a building, protecting surrounding building structure and furnishings, and quickly extinguishing the fire.

SUMMARY

The present invention provides a tree fire extinguishing device including an upright standing hollow body. An air compressor pump is connected to the hollow body for providing pressurized air to the hollow body. At least one heat activated fluid release valve is connected to the hollow body.

The present invention further provides a method of configuring a tree display. The method includes providing a tree fire extinguishing device including an upright standing substantially air-tight hollow body and a heat activated fluid release valve connected to the hollow body. A tree with a plurality of branches is provided. A fire extinguishing fluid is added to the upright standing substantially air-tight hollow body. An air space within the upright standing substantially air-tight hollow body is pressurized. The tree is positioned adjacent to the tree fire extinguishing device within a discharge area of the heat activated fluid release valve.

The present invention further provides a tree fire extinguishing device including an upright standing arcing hollow body comprising an inwardly curving surface. An air compressor pump is connected to the hollow body for providing pressurized air to the hollow body. A plurality of heat activated fluid release valves are connected to and extend from the inwardly curving surface of the hollow body Each of the plurality of heat activated fluid release valves comprise a fire sprinkler head comprising a trigger mechanism and a deflector head.

BRIEF DESCRIPTION OF THE DRAWING(S)

The foregoing Summary as well as the following detailed description will be readily understood in conjunction with the appended drawings which illustrate preferred embodiments of the invention. In the drawings.

DETAILED DESCRIPTION OF THE PREFERRED EMBODIMENT(S)

Figure 1:
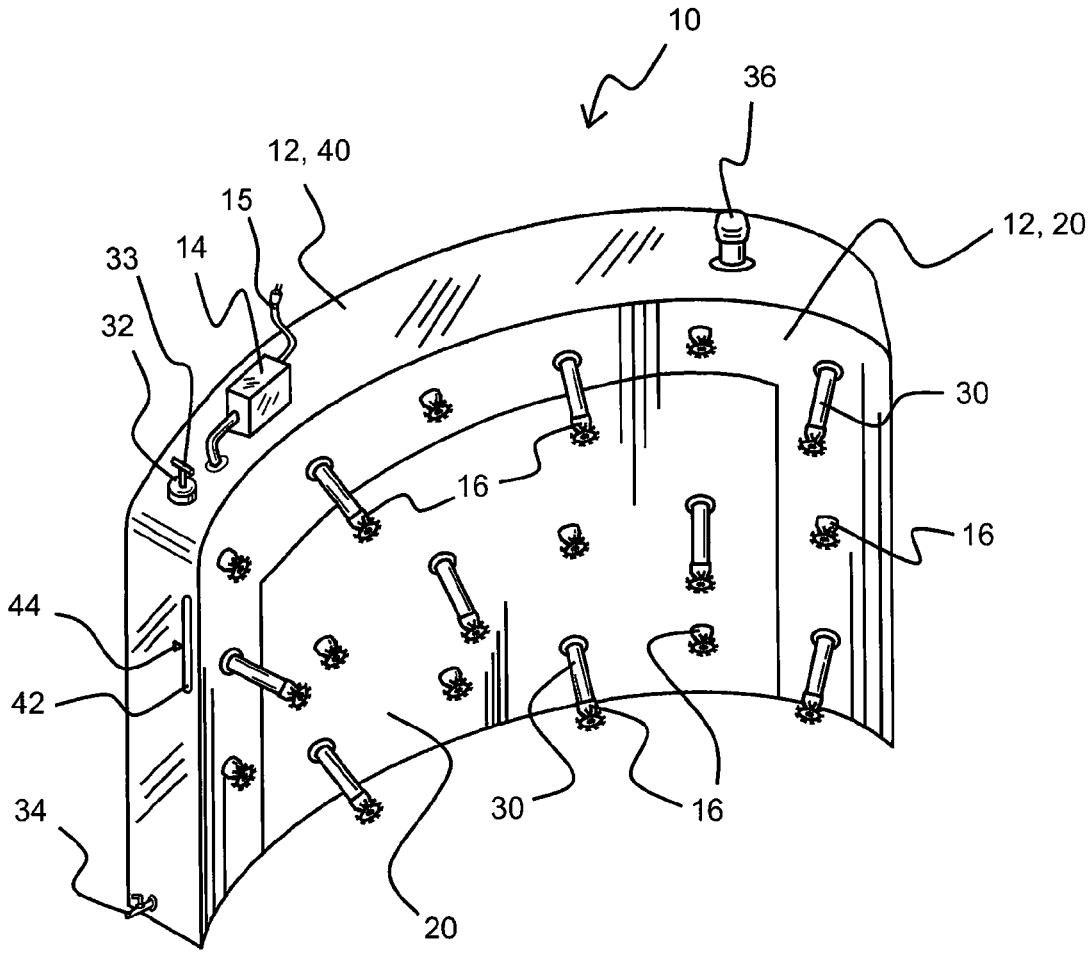
FIG. 1 is a top perspective view of a tree fire extinguishing device according to a preferred embodiment of the present invention.
Figure 2:
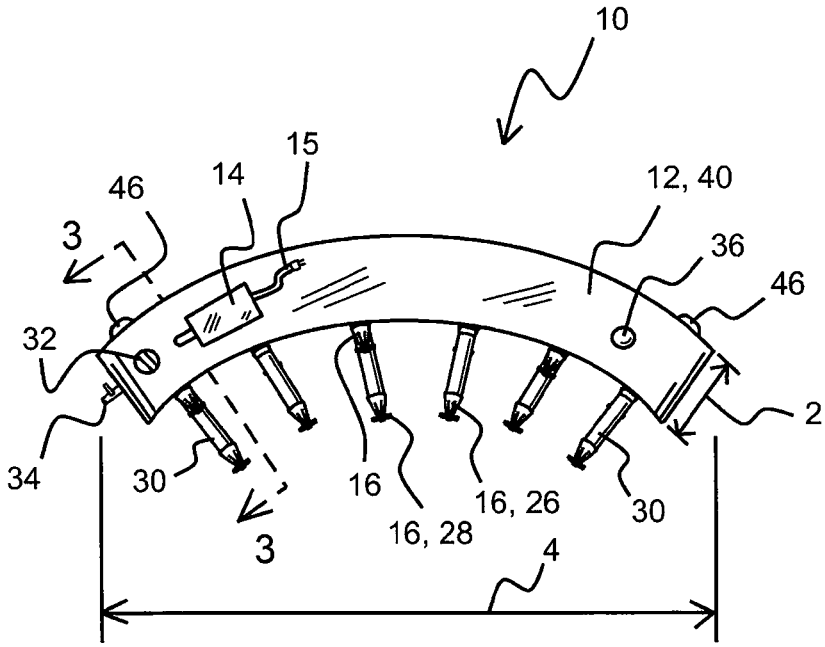
FIG. 2 is a top view of the tree fire extinguishing device of FIG. 1.
Figure 3:
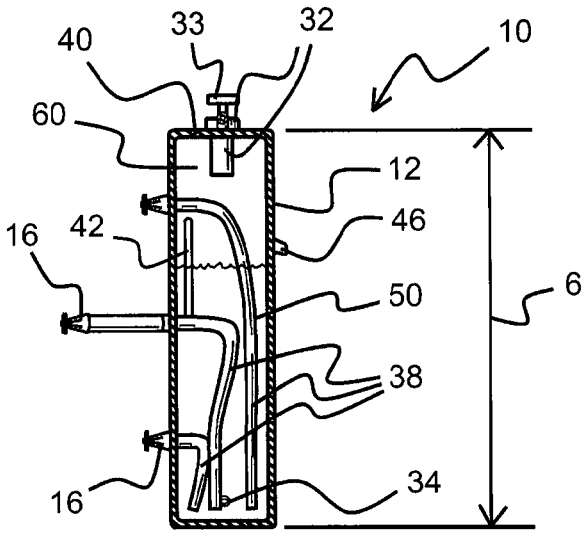
FIG. 3 is a cross-section view of the tree fire extinguishing device of FIG. 1 taken along line 3-3 in FIG. 2.

Certain terminology is used in the following description for convenience only and is not limiting. The words "right," "left," "top," and "bottom" designate directions in the drawings to which reference is made. The words "a" and "one" are defined as including one or more of the referenced item unless specifically stated otherwise. This terminology includes the words above specifically mentioned, derivatives thereof, and words of similar import. The phrase "at least one" followed by a list of two or more items, such as A, B, or C, means any individual one of A, B or C as well as any combination thereof.

The preferred embodiments of the present invention are described below with reference to the drawing figures where like numerals represent like elements throughout.

Referring to FIGS. 1-4, a tree fire extinguishing device 10 according to a preferred embodiment of the present invention is shown. The tree fire extinguishing device 10 includes an upright standing hollow body 12, an air compressor pump 14 connected to the hollow body 12 for providing pressurized air to the hollow body 12, and a plurality of heat activated fluid release valves 16 connected to the hollow body 12.

The upright standing hollow body 12 preferably includes a substantially air-tight body having a height 6 of at least three (3) times a depth 2 and having a width 4 of at least three (3) times the depth 2. The hollow body 12 has a low profile arcing form, as shown, with an inwardly curving surface 20, which enables it to maintain a stable upright position.

Preferably the hollow body 12 has a depth 2 of at least 12 cm, a width 4 of at least 1 meter and a height 6 of at least 1 meter. More preferably, the hollow body 12 has a depth 2 of at least 25 cm, a width 4 of at least 1.5 meters and a height 6 of at least 1.2 meters. Most preferably, the hollow body 12 has a depth 2 of about 30 cm, a width 4 of about 1.8 meters and a height 6 of about 1.4 meters. Alternatively, the hollow body 12 may be formed in any size suitable for a particular application. Further, supports may alternatively be provided external to the hollow body 12 to stabilize the hollow body 12 in its upright position. Moreover, the hollow body 12 may alternatively be formed flat instead of arcing, or alternatively formed in any suitable manner.

The hollow body 12 preferably comprises a fire resistant polymeric material having a material thickness of at least 3 millimeters. The hollow body 12 is preferably configured to maintain an internal gauge pressure of at least 2.7 bar (39 psig) without failure. Handles 46 are preferably provided integral with or attached to the hollow body 12 to facilitate handling of the tree fire extinguishing device 10.

The heat activated fluid release valves 16 preferably include fire sprinkler heads having a heat activated trigger mechanism 26 and a deflector head 28. Preferably, National Fire Protection Association (NFPA) standard fire sprinkler heads are used, having glass tube or releasable solder plate trigger mechanisms. Alternatively, any suitable heat activated fluid release valves using any suitable heat detection device may be used. The plurality of heat activated fluid release valves 16 are connected to the inwardly curving surface 20 of the hollow body 12 for dispersing a fire extinguishing fluid 50 from the interior of the hollow body 12. Preferably, the heat activated fluid release valves 16 are substantially evenly distributed on the curving surface 20. While eighteen heat activated fluid release valves 16 are shown, alternatively, any suitable number of heat activated fluid release valves 16 may be provided in any suitable distribution.

At least some of the heat activated fluid release valves 16 are connected to extenders 30 which are conduits allowing the release valves 16 to be positioned at a distance from the hollow body 12. The extenders 30 are preferably steel. Alternatively, the extenders 30 can be formed of any suitable material.

Tubes 38 within the hollow body 12 are connected to the release valves 16 and extend to a bottom portion of the hollow body 12 within the hollow body 12 for transporting the fire extinguishing fluid 50 from the hollow body 12 to the release valves 16. The tubes 38 are preferably flexible polymeric tubes. While a single one of the tubes 38 is shown connected to each of the release valves 16 and extending to the bottom portion of the hollow body 12, one skilled in the art will recognize that two or more of the release valves 16 may share a single tube, for example using a T or Y connector. Alternatively, any suitable manner of connecting tubes to the release valves 16 may be implemented for drawing fluid from the hollow body 12.

A closeable aperture on the hollow body 12 includes a removable cap 32 for adding or removing fluid 50 to the hollow body 12. The removable cap 32 is preferably a screw cap including an auxiliary air pump which may be manually actuated by pushing and retracting a pump handle 33 attached thereto. During use of the tree fire extinguishing device 10, the fire extinguishing fluid 50 may be added to the hollow body 12 by removing the cap 32. The removable cap 32 provides a substantially air-tight closure when attached to the hollow body 12. A fill and drain valve 34 is also preferably provided which permits fluid to be added or drained through connection of a fluid supply line. The fill and drain valve 34 may be any suitable valve, for example a typical residential garden hose valve. The preferred fire extinguishing fluid 50 for use with the tree fire extinguishing device 10 is water. Alternatively, any suitable fire extinguishing fluid can be used.

The air compressor pump 14 is preferably electrically powered and includes an electric power cord 15. The air compressor pump 14 may include a reservoir tank for holding compressed air or be provided without a reservoir tank. Alternatively, a manual air compressor pump may be provided, for example a hand-operated air compressor pump. The air compressor pump 14 is preferably configured to pressurize an air space 60 between the fire extinguishing fluid 50 and a top portion 40 of the hollow body. The air compressor pump 14 is preferably configured to pressurize the air space 60 to a gauge pressure between about 0.7 bar (10 psig) and 2.0 bar (29 psig). Alternatively, the air compressor pump 14 can be configured to provide any suitable air pressure within the air space 60. A pressure release valve 36 is preferably provided to permit the release of air if air pressure exceeds a predetermined limit. When one or more of the release valves 16 are triggered by a rise in heat, the fire extinguishing fluid 50 is forced by the compressed air through the tubes 38 into the one or more triggered release valves 16 and out of the tree fire extinguishing device 10 into a discharge area.

A view window 42 is preferably provided to permit a user to see a level of the fire extinguishing fluid 50 in the hollow body 12. An indicia 44 is provided adjacent to, or alternatively, integral with the view window 42 to indicate to a user a maximum predetermined fluid fill level. The predetermined maximum fluid fill level is selected such that a sufficient volume of compressed air is present in the air space 60 between the fire extinguishing fluid 50 and the top portion 40 of the hollow body 12 to allow an adequate amount of fire extinguishing fluid 50 at sufficient force to be released in the event of a fire.

Figure 4:
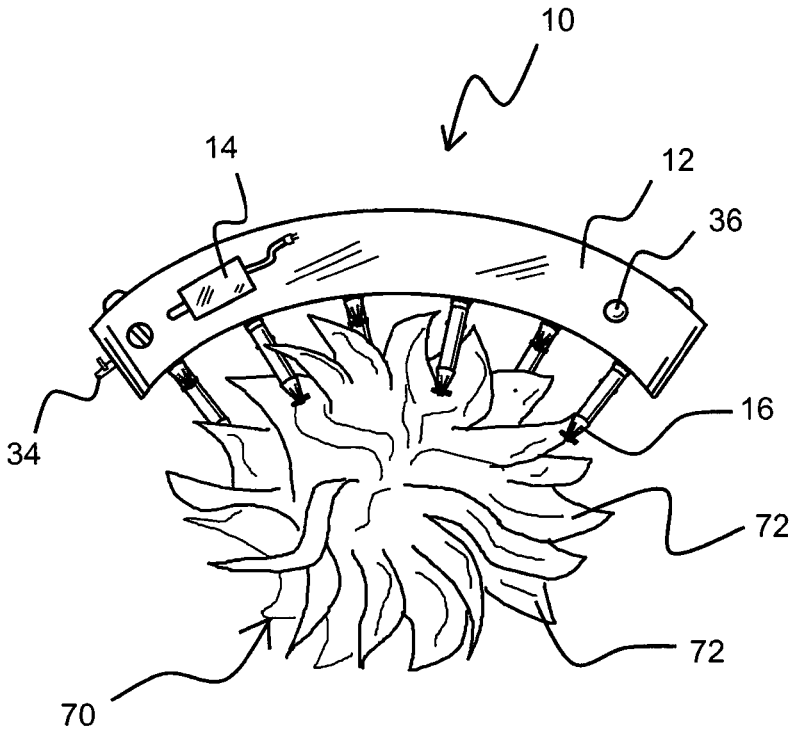
FIG. 4 is a top view of the tree fire extinguishing device of FIG. 1, shown used in a preferred manner with a tree positioned adjacent thereto.

Referring to FIG. 4, a tree 70 having a plurality of branches 72 is shown positioned in a preferred manner next to the tree fire extinguishing device 10 in a discharge area of the fire extinguishing device 10. As shown, some of the fluid release valves 16 extend into an area defined by the ends of the plurality of branches 72 potentially allowing for better heat sensing and fire extinguishing effectiveness. Alternatively, the tree 70 may be removed a distance from the tree fire extinguishing device 10.

In the event of a fire, the hollow body 12 filled with the fire extinguishing fluid 50 may act to prevent surrounding structure or furnishings from heat and fire damage, and one or more of the fluid release valves 16 may be activated by the heat of the fire thereby dispersing fluid on the tree and extinguishing the flames. While not wishing to be limited by any particular theory of functionality, the hollow body 12 by virtue of being filled with the fire extinguishing fluid 50 will potentially rise in temperature at a slower rate than building furnishings or structures during a fire event. Moreover, the arcing form of the hollow body 12 is capable of surrounding a significant portion of a tree to potentially contain heat and flames and protect surrounding structure or furnishings.

Figure 5:
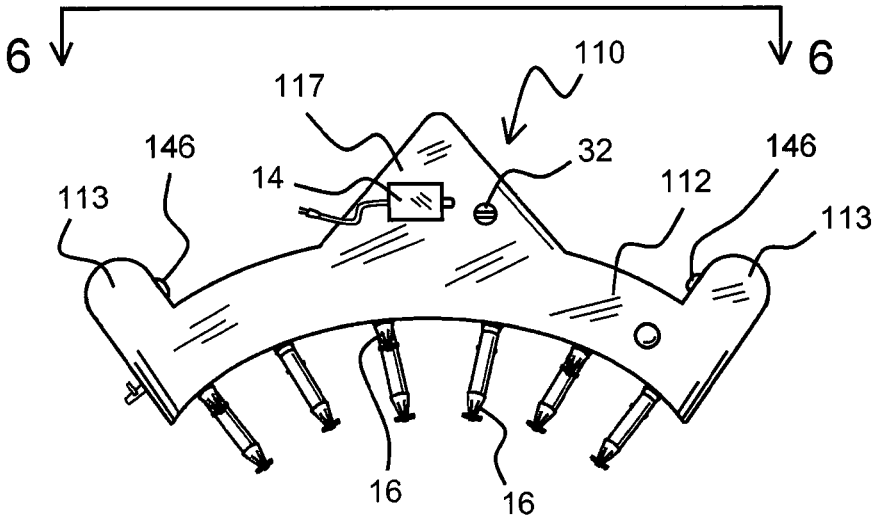
FIG. 5 is a top view of a tree fire extinguishing device according to another preferred embodiment of the present invention.
Figure 6:
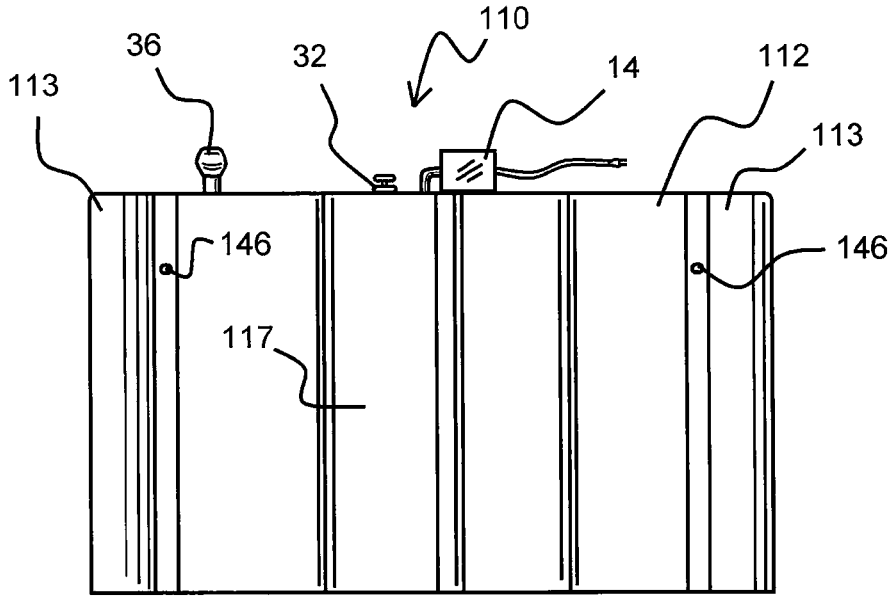
FIG. 6 is rear elevation view of the tree fire extinguishing device of FIG. 5 taken along line 6-6 in FIG. 5.

Referring to FIGS. 5 and 6, a tree fire extinguishing device 110 according to another preferred embodiment of the present invention is shown. The tree fire extinguishing device 110 is similar in operation to the tree fire extinguishing device 10 set forth above, but includes a hollow body 112 having additional capacity portions 113, 117. The portions 113, 117 are in fluid connection with the remaining portion of the hollow body 112 and serve to increase the volume of fire extinguishing fluid 50 and compressed air which can be stored by the hollow body 112. Moreover the portions 113, 117 provide additional stability to the extinguishing device 110. Handles 146 are provided to facilitate handling of the tree fire extinguishing device 110.

Figure 7:
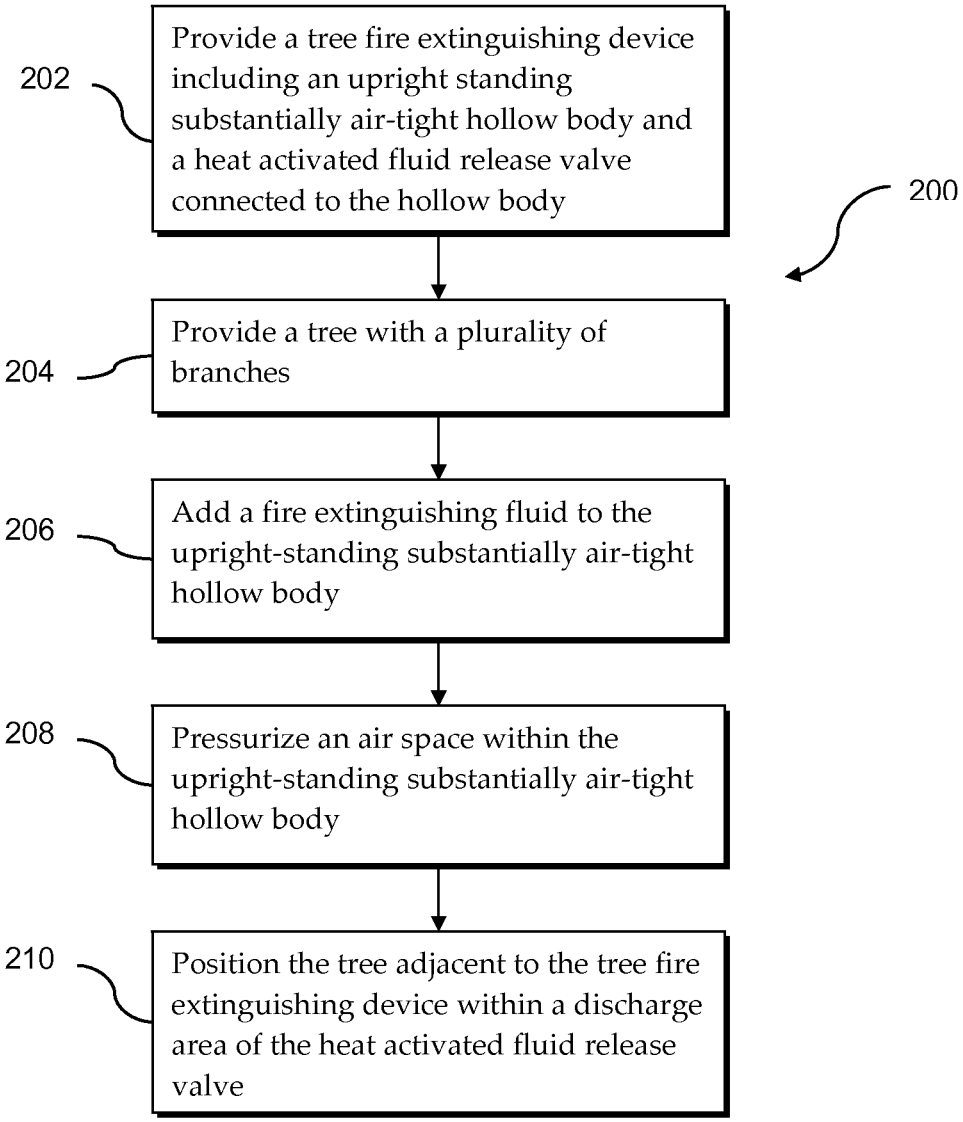
FIG. 7 is a flowchart diagram showing a method of configuring a tree display according to a preferred embodiment of the present invention.

Referring to FIG. 7, a flow chart diagram of a method 200 of configuring a tree display is shown. The method 200 includes providing a tree fire extinguishing device including an upright standing substantially air-tight hollow body and a heat activated fluid release valve connected to the hollow body (step 202). A tree with a plurality of branches is provided (step 204). A fire extinguishing fluid is added to the upright standing substantially air-tight hollow body (step 206). An air space within the upright standing substantially air-tight hollow body is pressurized (step 208). The tree is positioned adjacent to the tree fire extinguishing device within a discharge area of the heat activated fluid release valve (step 210).

Figure 8:
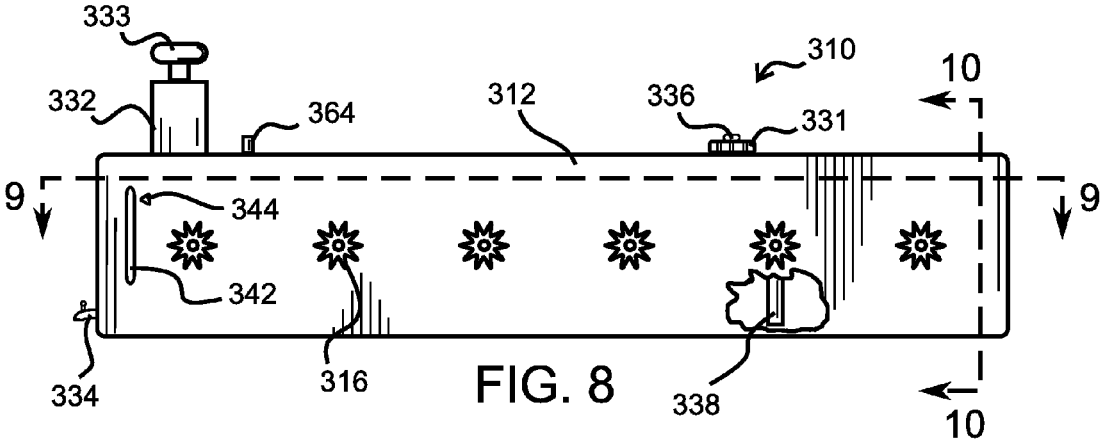
FIG. 8 is a front elevation view with a cutaway portion showing a fire extinguishing device according to yet another preferred embodiment of the present invention.
Figure 9:
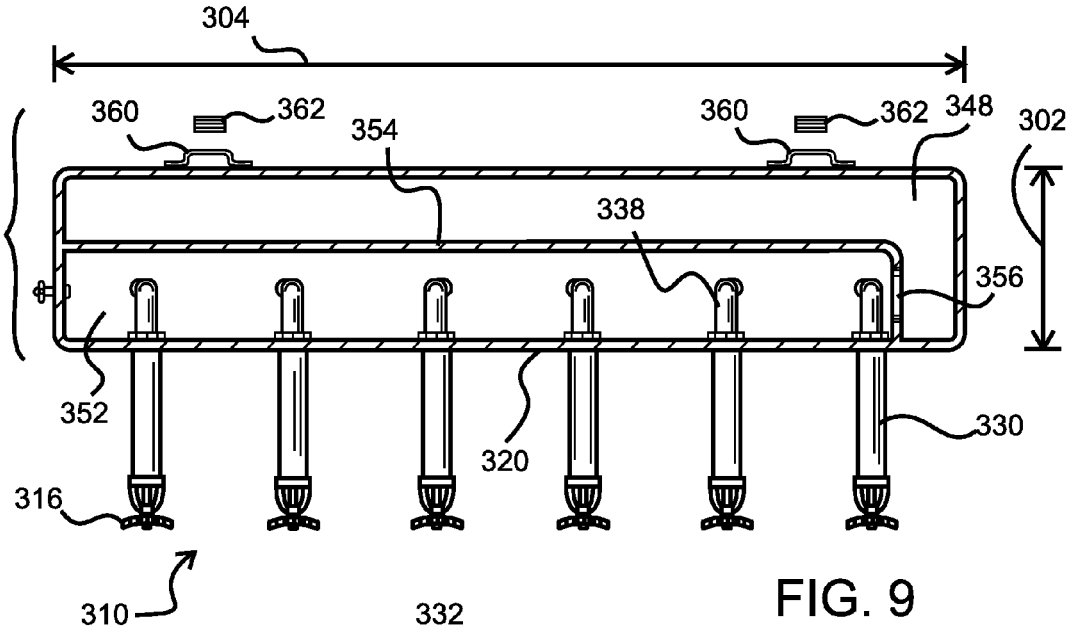
FIG. 9 is a cross-section view taken along line 9-9 of FIG. 8.
Figure 10:
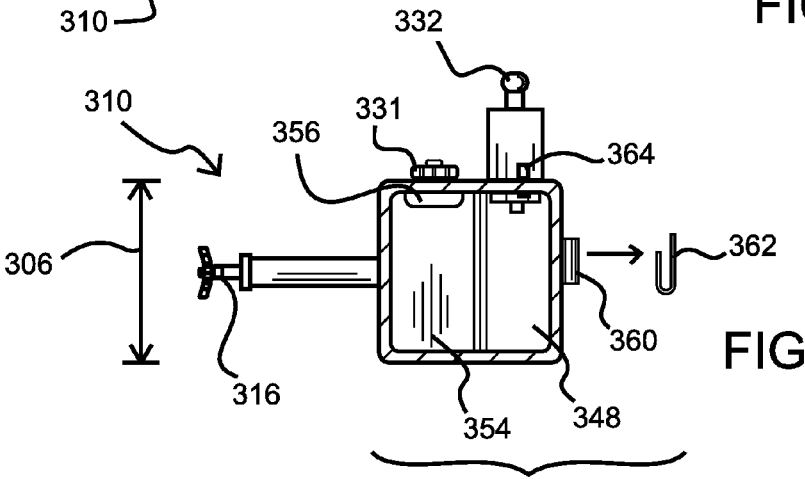
FIG. 10 is a cross-section view taken along line 10-10 of FIG. 8.

Referring to FIGS. 8 through 10, a fire extinguishing device 310 according to another preferred embodiment of the present invention is shown. The fire extinguishing device 310 includes a hollow body 312 having a gas reservoir 348 for maintaining an adequate supply of pressurized air. The gas reservoir 348 is separated from a fluid reservoir 352 by a partition 354. The partition 354 includes a passage aperture 356 at a top portion of the partition 354 to permit passage of pressurized air.

Extinguishing fluid can be added to the fluid reservoir 352 via an aperture sealed by a removable fill cap 331. The removable fill cap 331 provides a substantially air-tight closure when attached to the hollow body 312. Fluid also can be added to or removed from the fluid reservoir 352 via a fill and drain valve 334. A view window 342 is preferably provided to permit a user to see a level of the fire extinguishing fluid in the hollow body 312. An indicia 344 is provided adjacent to, or alternatively, integral with the view window 342 to indicate to a user a maximum predetermined fluid fill level. The predetermined maximum fluid fill level is selected such that extinguishing fluid does not spill through the passage aperture 356 into the gas reservoir 348 and such that a sufficient volume of compressed air is present in the hollow body 312 to allow an adequate amount of fire extinguishing fluid at sufficient force to be released in the event of a fire.

The hollow body 312 preferably includes a substantially air-tight elongated barrier forming body having a height 306 approximately equal to the depth 302 and having a width 304 approximately five (5) times the depth 302. In a preferred embodiment, the depth 302 and the height 306 can be approximately 1 foot and the width 304 can be approximately 5 feet. Alternatively, the hollow body 312 can be scaled as required by a particular application. The hollow body 312 preferably has a generally planar non-arcing form to permit efficient installation adjacent to a planar surface. Hanging brackets 360 are preferably provided to permit connection of the fire extinguishing device 310 to a planar surface such as an interior building wall. Fastener-mountable wall brackets 362 for connection to a wall or other structure are preferably provided which removeably connect to the hanging brackets 360 for securing the fire extinguishing device 310 to a wall or other structure.

Heat activated fluid release valves 316 are provided which preferably include fire sprinkler heads. Preferably, National Fire Protection Association (NFPA) approved standard fire sprinkler heads are used, having expendable glass tube or releasable solder plate trigger mechanisms and threads to permit threaded fastening. Once activated, the heat activated fluid release valves 316 can be replaced to permit reuse of the fire extinguishing device 310, if the fire extinguishing device 310 is not damaged by the condition which caused the activation. The plurality of heat activated fluid release valves 316 are connected to extenders 330 which are connected to a flat surface 320 of the hollow body 312 for dispersing fire extinguishing fluid from the fluid reservoir 352. Preferably, the heat activated fluid release valves 316 are as shown substantially evenly distributed on the flat surface 320.

The extenders 330 are conduits allowing the release valves 316 to be positioned at a distance from the hollow body 312. The extenders 330 are preferably steel and extend a distance of approximately 12 inches from the hollow body 312. Alternatively, the extenders 330 can be formed of a polymeric material or any suitable material at any suitable length. The extenders 330 can be attached to the hollow body 312 via a threaded connection, or alternatively, the extenders 330 can be integrally formed with the hollow body 312. Tubes 338 within the hollow body 312 are connected to the release valves 316 via the extenders 330 and extend to a bottom portion of the hollow body 312 within the fluid reservoir 352 for transporting the fire extinguishing fluid from the fluid reservoir 352 to the release valves 316. Configured as such, the release valves 316 are in fluid communication with the fluid reservoir 352. The tubes 338 are preferably flexible polymeric tubes.

A hand-operated air pump 332 is connected to the hollow body 312 and can be manually actuated by pushing and retracting a pump handle 333 attached thereto. The hand-operated pump 332 is preferably connected via threaded connection. A gas valve 364 is provided to permit adding compressed air or other gas from an external source. The preferred fire extinguishing fluid for use with the fire extinguishing device 310 is water. Alternatively, any suitable fire extinguishing fluid can be used. As shown, the fire extinguishing device 310 is configured to require addition of the fire extinguishing fluid prior to being pressurized via the air pump 332 or the gas valve 364.

The hollow body 312 is preferably configured to be pressurized to a gauge pressure of between about 0.7 bar (10 psig) and 2.0 bar (29 psig). Alternatively, the hollow body 312 can be configured to be pressurized to any suitable air pressure, depending on the components and material used to construct the fire extinguishing device 310. A pressure release valve 336 is preferably provided integral with the fill cap 331 to permit the release of air if air pressure exceeds a predetermined limit. When one or more of the heat activated release valves 316 are triggered by a rise in heat, fire extinguishing fluid is forced by the compressed air through the tubes 338 into the one or more triggered release valves 316 and out of the fire extinguishing device 310 into a discharge area.

While not wishing to be limited by any particular application for the fire extinguishing device 310 of FIGS. 8-10, the fire extinguishing device 310 is effective at extinguishing fires of objects or materials such as home furnishings or structures within the recited discharge area. The fire extinguishing device 310 can function as a portable home sprinkler system, which functioning is desirable since most private homes and many businesses are without integrated sprinkler systems. The fire extinguishing device 310 can be conveniently mounted on a wall or placed on a floor or shelf as space permits in a particular room.

Referring to FIGS. 11 through 14, a fire extinguishing device 410 according to another preferred embodiment of the present invention is shown. The fire extinguishing device 410 includes a hollow body 412 having a gas reservoir 448 for maintaining an adequate supply of pressurized air. The gas reservoir 448 is separated from a fluid reservoir 452 by a partition 454. The partition 454 includes a passage aperture 456 at a top portion of the partition 454 to permit passage of pressurized air.

A closeable aperture on the hollow body 412 includes a hand-operated air pump 431 including a removable cap 432 for adding or removing fluid to the fluid reservoir 452 of the hollow body 12. The removable cap 432 is preferably a screw cap. The air pump 431 may be manually actuated by pushing and retracting a pump handle 433 attached thereto to pressurize the hollow body 412. During use of the fire extinguishing device 410, a fire extinguishing fluid may be added to the hollow body 412 by removing the cap 432. The removable cap 432 provides a substantially air-tight closure when attached to the hollow body 412. A view window 442 is preferably provided to permit a user to see a level of the fire extinguishing fluid in the hollow body 412. An indicia 444 is provided adjacent to, or alternatively, integral with the view window 442 to indicate to a user a maximum predetermined fluid fill level. The predetermined maximum fluid fill level is selected such that extinguishing fluid does not spill through the passage aperture 456 into the gas reservoir 448 and such that a sufficient volume of compressed air is present in the hollow body 412 to allow an adequate amount of fire extinguishing fluid at sufficient force to be released in the event of a fire.

As shown, the hollow body 412 preferably includes a substantially air-tight barrier forming elongated body having a height 406 approximately equal to the depth 402 and having a width 404 approximately five (5) times the depth 402. In a preferred embodiment, the depth 402 and the height 406 can be approximately 1 foot and the width 404 can be approximately 5 feet. Alternatively, the hollow body 412 can be scaled as required by a particular application. The hollow body 412 preferably has a generally planar non-arcing form to permit efficient installation adjacent to a planar surface. Hanging brackets 460 are preferably provided to permit connection of the fire extinguishing device 410 to a planar surface such as an interior building ceiling or wall. Fastener-mountable ceiling brackets 462 for connection to a ceiling or other structure are preferably provided which removeably connect to the hanging brackets 460 for securing the fire extinguishing device 410 to a ceiling or horizontal other structure. Fasteners may be inserted through apertures 463 in the ceiling brackets 462 for attaching the ceiling brackets 462 to a ceiling or other horizontal surface. Alternatively, the fastener-mountable wall brackets 362 shown in FIGS. 9 and 10 can be provided which can removeably connect to the hanging brackets 460 for securing the fire extinguishing device 410 to a wall or other vertical structure.

Heat activated fluid release valves 416 are provided which preferably include fire sprinkler heads. Preferably, National Fire Protection Association (NFPA) approved standard fire sprinkler heads are used, having expendable glass tube or releasable solder plate trigger mechanisms and threads to permit threaded fastening. Once activated, the heat activated fluid release valves 416 can be replaced to permit reuse of the fire extinguishing device 410, if the fire extinguishing device 410 is not damaged by the condition which caused the activation. The plurality of heat activated fluid release valves 416 are connected to extenders 430 which are connected to a flat surface 420 of the hollow body 412 for dispersing fire extinguishing fluid from the fluid reservoir 452. Preferably, the heat activated fluid release valves 416 are as shown substantially evenly distributed on the flat surface 420.

The extenders 430 are conduits allowing the release valves 416 to be positioned at a distance from the hollow body 412. The extenders 430 are preferably steel and extend a distance of approximately 12 inches from the hollow body 412. Alternatively, the extenders 430 can be formed of a polymeric material or any suitable material at any suitable length. The extenders 430 can be attached to the hollow body 412 via a threaded connection, or alternatively, the extenders 430 can be integrally formed with the hollow body 412. Configured as such, the release valves 416 are in fluid communication with the fluid reservoir 452. The preferred fire extinguishing fluid for use with the fire extinguishing device 410 is water. Alternatively, any suitable fire extinguishing fluid can be used.

The hollow body 412 is preferably configured to be pressurized to a gauge pressure of between about 0.7 bar (10 psig) and 2.0 bar (29 psig). Alternatively, the hollow body 412 can be configured to be pressurized to any suitable air pressure, depending on the components and material used to construct the fire extinguishing device 410. When one or more of the heat activated release valves 416 are triggered by a rise in heat, fire extinguishing fluid is forced by the compressed air through the extenders 430 into the one or more triggered release valves 416 and out of the fire extinguishing device 410 into a discharge area.

Figure 11:
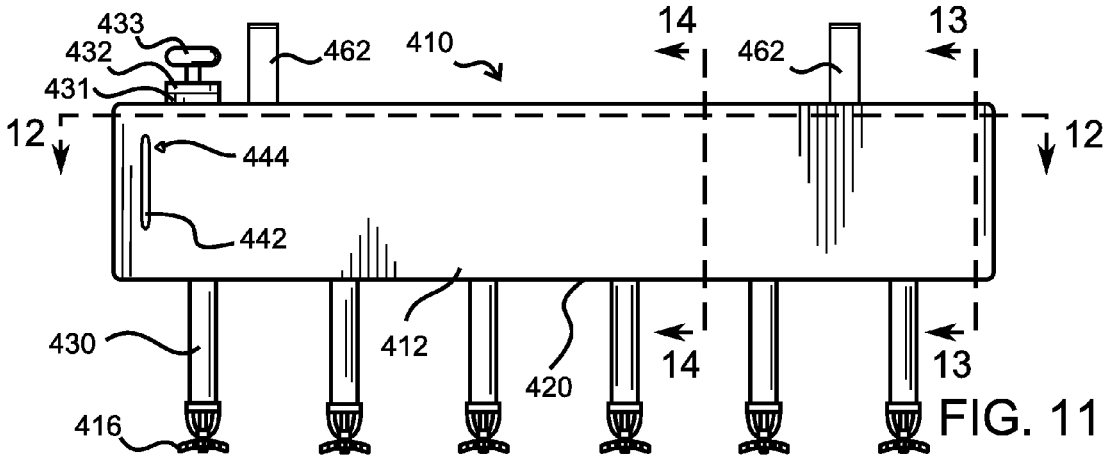
FIG. 11 is a front elevation view with a cutaway portion showing a fire extinguishing device according to yet another preferred embodiment of the present invention.
Figure 12:
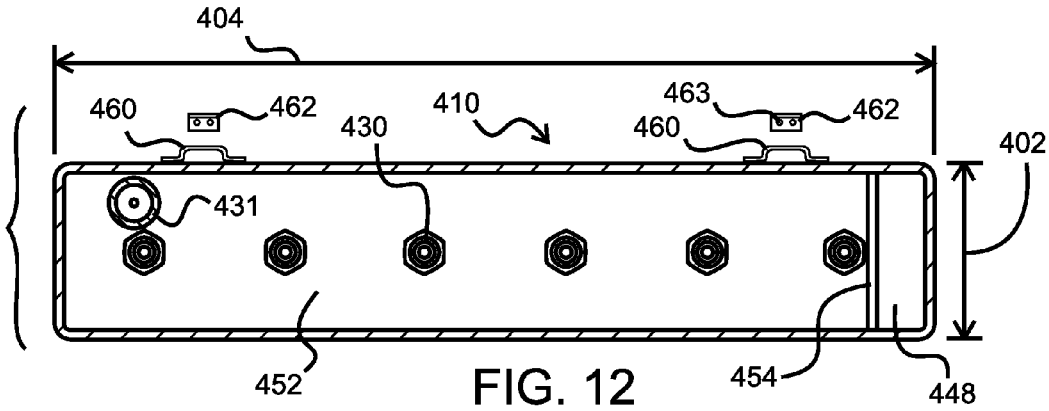
FIG. 12 is a cross-section view taken along line 12-12 of FIG. 11.
Figure 13:
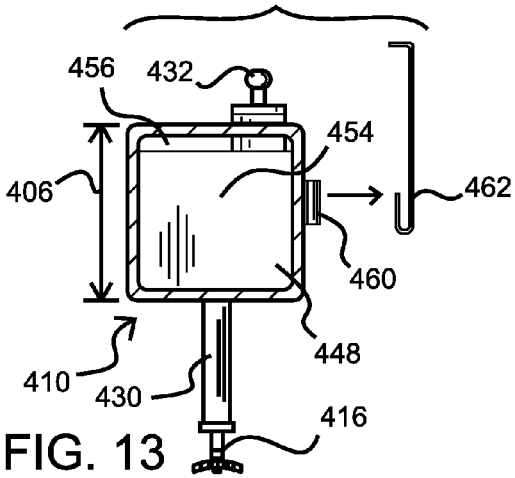
FIG. 13 is a cross-section view taken along line 13-13 of FIG. 11.
Figure 14:
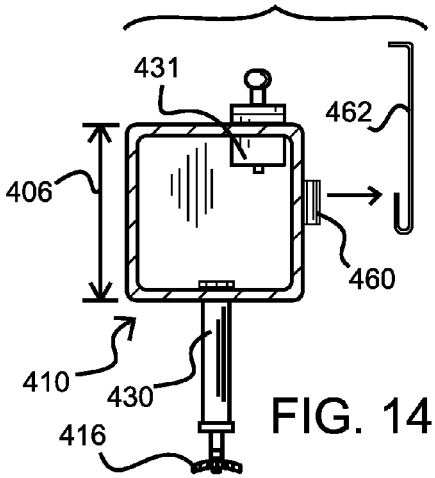
FIG. 14 is a cross-section view taken along line 14-14 of FIG. 11.

While not wishing to be limited by any particular application for the fire extinguishing device 410 of FIGS. 11-13, the fire extinguishing device 410 is effective at extinguishing fires of objects or materials such as home furnishings or structures within the recited discharge area. The fire extinguishing device 410 can function as a portable home sprinkler system, which functioning is desirable since most private homes and many businesses are without integrated sprinkler systems. The fire extinguishing device 410 can be conveniently mounted on a ceiling or wall.

The present invention further provides a method including providing a fire extinguishing device, such as the fire extinguishing device 310 of FIGS. 8-10 or the fire extinguishing device 410 of FIGS. 11-13, and adding fire extinguishing fluid and pressurized air to the fire extinguishing device. The method further includes connecting brackets such as the wall brackets 362 or ceiling brackets 462 to an interior building structure such as a wall or ceiling and connecting the fire extinguishing device to the brackets.

While the preferred embodiments of the invention have been described in detail above, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. A self-contained user-transportable heat activated fire extinguishing device comprising:

a barrier forming hollow body comprising a surface which defines a discharge area at least partially surrounded by the surface;

an air compressor pump connected to the hollow body for providing pressurized air to the hollow body;

a plurality of heat activated fluid release valves connected to and extending from the surface into the discharge area; and structure for removable attachment of the fire extinguishing device by a user to a surface, wherein the discharge area is defined by user positioning of the fire extinguishing device.

2. The fire extinguishing device of claim 1, wherein the hollow body comprises an elongated barrier forming body.

3. The fire extinguishing device of claim 1, wherein the hollow body comprises a fire resistant polymeric material.

4. The fire extinguishing device of claim 1, wherein the plurality of heat activated fluid release valves comprise at least one fire sprinkler head comprising a heat activated trigger mechanism and a deflector head.

5. The fire extinguishing device of claim 1, further comprising at least one extender which connects at least one of the plurality of heat activated fluid release valves to the hollow body.

6. The fire extinguishing device of claim 1, wherein the structure for removable attachment comprises at least one hanging bracket connected to the hollow body for connecting the fire extinguishing device to at least one of a substantially vertical surface and a substantially horizontal surface.

7. The fire extinguishing device of claim 6, further comprising at least one of a ceiling bracket and a wall bracket removably connected to the hanging bracket.

8. The fire extinguishing device of claim 1, wherein the plurality of heat activated fluid release valves comprise a plurality of fire sprinkler heads, comprising a trigger mechanism and a deflector head, connected to the surface of the hollow body, and wherein the fire extinguishing device further comprises at least one extender which connects at least one of the plurality of fire sprinkler heads to the surface of the hollow body.

9. The fire extinguishing device of claim 1, wherein the plurality of heat activated fluid release valves comprise a plurality of NFPA standard fire sprinkler heads.

10. The fire extinguishing device of claim 1, wherein the hollow body comprises a substantially flat surface to which the plurality of heat activated fluid release valves are connected.

11. A fire extinguishing device comprising:

a barrier forming hollow body comprising a surface which defines a discharge area at least partially surrounded by the surface;

an air compressor pump connected to the hollow body for providing pressurized air to the hollow body; and a plurality of heat activated fluid release valves connected to and extending from the surface into the discharge area;

wherein the barrier forming hollow body further comprises:

a gas reservoir;

a fluid reservoir;

a closeable aperture for adding extinguishing fluid to the fluid reservoir; and a partition separating the fluid reservoir from the gas reservoir, wherein the partition comprises a passage aperture configured to permit a flow of air into the fluid reservoir, and wherein the fluid reservoir is in fluid communication with the heat activated fluid release valves.

12. The fire extinguishing device of claim 11, further comprising:

a view window connected to the hollow body; and an indicia for indicating a maximum fill level of the fluid reservoir, wherein the indicated maximum fill level is predetermined to substantially preclude passage of fluid through the passage aperture from the fluid reservoir into the gas reservoir.

13. The fire extinguishing device of claim 1, wherein the plurality of heat activated fluid release valves comprise an array of at least 4 heat activated fluid release valves.

14. A self-contained user-transportable heat activated fire extinguishing device comprising:

an elongated barrier forming hollow body comprising a surface which defines a discharge area;

an air compressor pump connected to the hollow body for providing pressurized air to the hollow body;

a plurality of longitudinally spaced heat activated fluid release valves connected to and extending from the surface into the discharge area; and structure for removable attachment of the fire extinguishing device by a user to a surface, wherein the discharge area is defined by user positioning of the fire extinguishing device.

15. The fire extinguishing device of claim 14, wherein the elongated barrier forming hollow body is configured for connection to at least one of a wall and a ceiling with the plurality of fluid longitudinally spaced heat activated fluid release valves extending downward away from the ceiling into the discharge area.

16. The fire extinguishing device of claim 14, wherein the air compressor pump comprises a hand-operated pump comprising a pump handle.

* * * * *